US007089742B2

(12) United States Patent
Spooner et al.

(10) Patent No.: US 7,089,742 B2
(45) Date of Patent: Aug. 15, 2006

(54) WALL ELEMENTS FOR GAS TURBINE ENGINE COMBUSTORS

(75) Inventors: Michael P. Spooner, Littleover (GB); Anthony Pidcock, Chellaston (GB); Desmond Close, Spondon (GB)

(73) Assignee: Rolls-Royce plc, London (GB)

( * ) Notice: Subject to any disclaimer, the term of this patent is extended or adjusted under 35 U.S.C. 154(b) by 544 days.

(21) Appl. No.: 10/635,482

(22) Filed: Aug. 7, 2003

(65) Prior Publication Data

US 2006/0117755 A1 Jun. 8, 2006

(51) Int. Cl.
*F23R 3/00* (2006.01)

(52) U.S. Cl. ..... 60/753

(58) Field of Classification Search ..... 60/752, 60/753, 760, 723

See application file for complete search history.

(56) References Cited

U.S. PATENT DOCUMENTS 5,323,601 A * 6/1994 Jarrell et al. ..... 60/752
5,331,816 A * 7/1994 Able et al. ..... 60/753
5,460,002 A * 10/1995 Correa ..... 60/723
5,528,904 A * 6/1996 Jones et al. ..... 60/753
6,170,266 B1 * 1/2001 Pidcock et al. ..... 60/755
6,250,082 B1 * 6/2001 Hagle et al. ..... 60/753
6,272,863 B1 * 8/2001 Pfefferle et al. ..... 60/723

* cited by examiner

*Primary Examiner*—Michael Koczo, Jr.
(74) *Attorney, Agent, or Firm*—W. Warren Taltavull; Manelli Denison & Selter PLLC

(57) ABSTRACT

A wall element (29) for a wall structure (21) of a gas turbine engine combustor (15). The wall element (29) comprises a main member (36) with an upstream edge region (30) and a downstream edge region (31). A plurality of heat removal members (38) are provided on the main member (36). The downstream edge (35) of the wall element and/or the downstream facing surface of the heat removal members closest to the downstream edge (35) are provided with a thermally resistant coating.

5 Claims, 3 Drawing Sheets

WALL ELEMENTS FOR GAS TURBINE ENGINE COMBUSTORS

This invention relates to wall elements for gas turbine engine combustors.

A typical gas turbine engine combustor includes a generally annular chamber having a plurality of fuel injectors at an upstream head end. Combustion air is provided through the head and in addition through primary and intermediate mixing ports provided in the combustor walls, downstream of the fuel injectors.

In order to improve the thrust and fuel consumption of gas turbine engines, i.e. the thermal efficiency, it is necessary to use high compressor pressures and combustion temperatures. Higher compressor pressures give rise to higher compressor outlet temperatures and higher pressures in the combustion chamber.

There is, therefore, a need to provide effective cooling of the combustion chamber walls. One cooling method which has been proposed is the provision of a double walled combustion chamber, in which the inner wall is formed of a plurality of heat resistant tiles. Cooling air is directed into the gap between the outer wall and the tiles, and is then exhausted into the combustion chamber.

The tiles can be provided with a plurality of pedestals which assist in removing heat from the tile. However, it has been found that certain parts of the tile are still prone to overheating and subsequent erosion by oxidation.

According to one aspect of this invention, there is provided a wall element for a wall structure of a gas turbine engine combustor, the wall element including at least one surface, the surface, in use, faces in a downstream direction relative to the general direction of fluid flow through the combustor, wherein said surface comprises a thermally resistant material.

The wall element preferably includes a main body member, the main body member comprising upstream and downstream edges. The downstream edge preferably comprise a downstream facing surface, the downstream facing surface comprising said thermally resistant material. The wall element may have a plurality of upstanding heat removal members provided on the main body member. Each heat removal member furthest downstream on the main body member may comprise the thermally resistant material. The heat removal members may have a substantially circular cross-section.

The wall element preferably comprises a tile. The heat removal members are preferably heat removal pedestals. Advantageously, the thermally resistant material extends substantially the whole length of the heat removal member or members.

The thermally resistant material may be a coating, suitably a thermal barrier coating, for example magnesium zirconate or yttria stabilised zirconia.

In one embodiment, the heat removal members are substantially cylindrical in configuration, the surface of the, or each, member provided with said thermally resistant material comprising a downstream facing arc. Preferably said arc subtends an angle of at least substantially 90°, and more preferably substantially 180°. Preferably the angle subtended by said arc is no more than substantially 180°.

According to another aspect of this invention, there is provided an inner wall structure for a combustor of a gas turbine engine, the wall structure comprising a plurality of wall elements as described above.

An embodiment of the invention will now be described by way of example only with reference to the accompanying drawings in which:—

Figure 1:
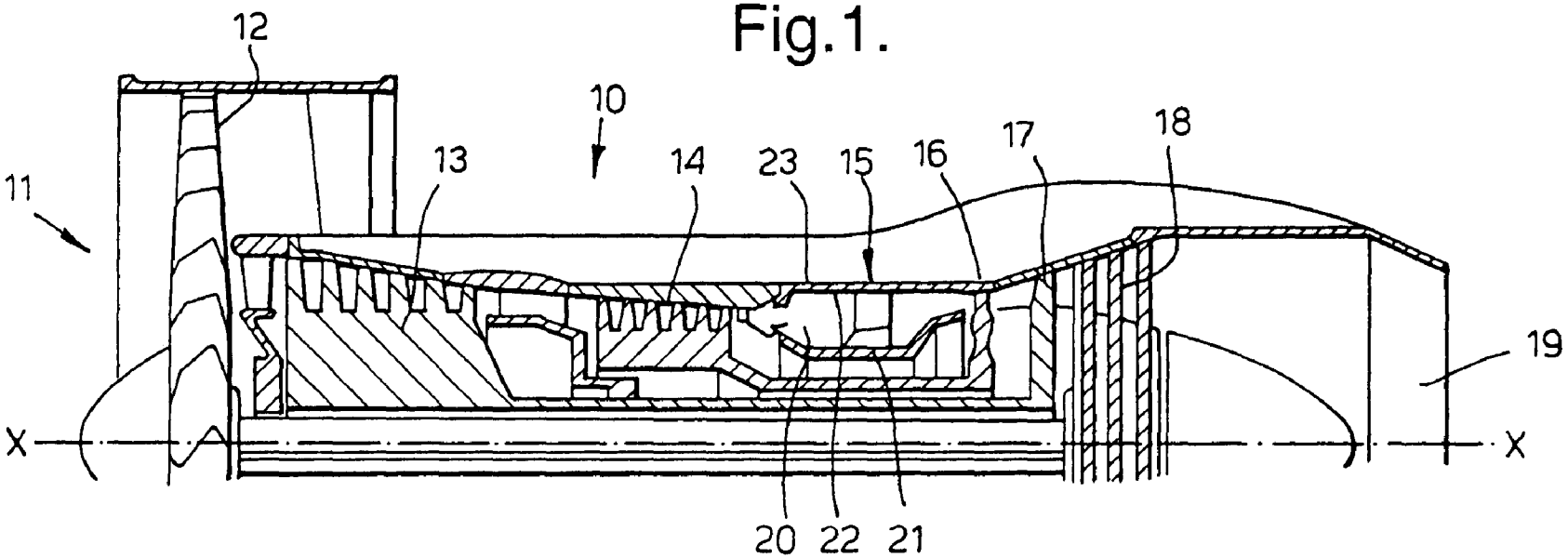
FIG. 1 is a sectional side view of the upper half of a gas turbine engine.

Referring to FIG. 1, a gas turbine engine generally indicated at 10 has a principal axis X-X. The engine 10 comprises, in axial flow series, an air intake 11, a propulsive fan 12, an intermediate pressure compressor 13, a high pressure compressor 14, a combustor 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
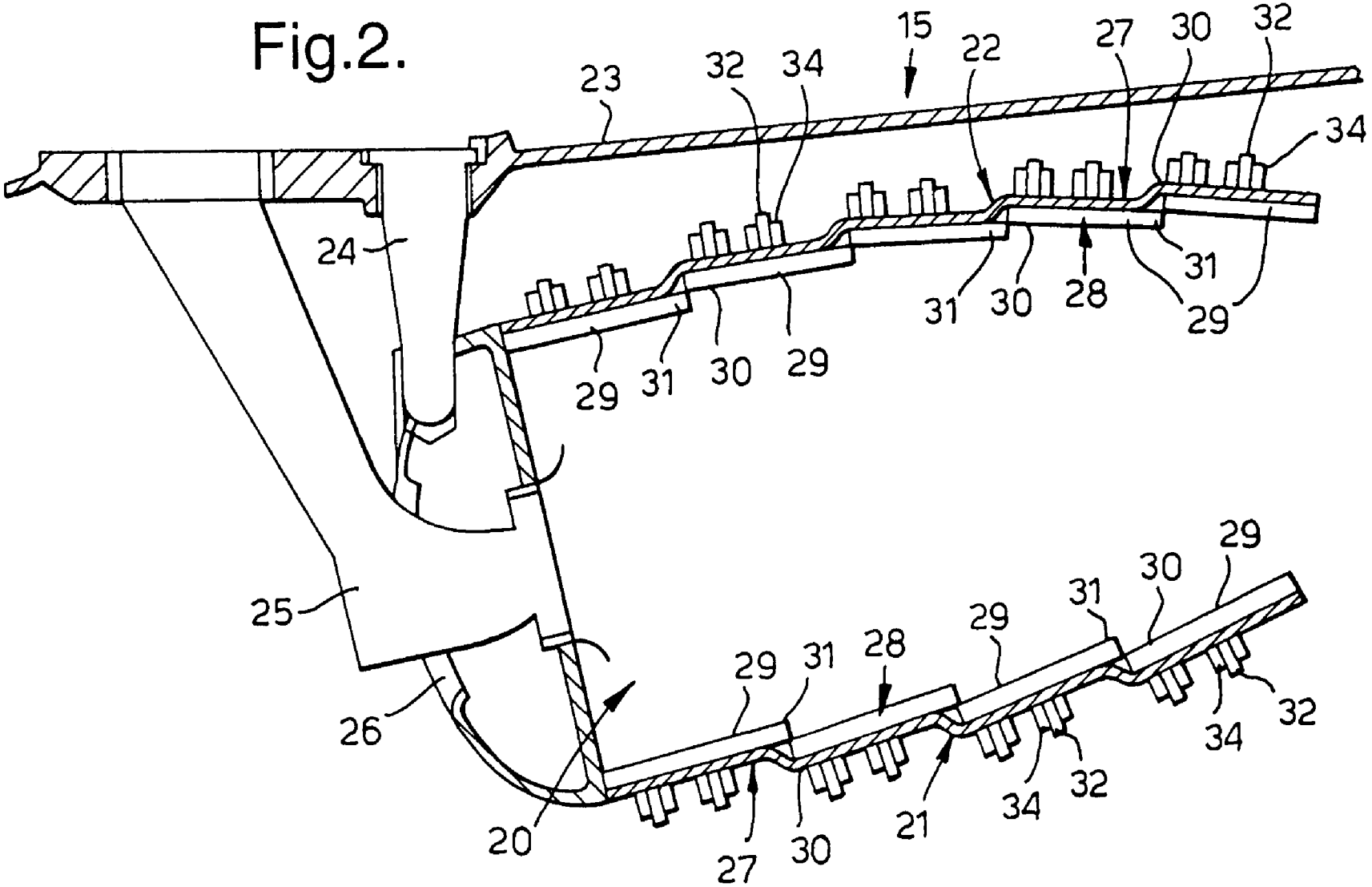
FIG. 2 is a vertical cross-section through the combustor of the gas turbine engine shown in FIG. 1.

Referring to FIG. 2, the combustor 15 is constituted by an annular combustion chamber 20 having radially inner and outer wall structures 21 and 22 respectively. The combustion chamber 20 is secured to an engine casing 23 by a plurality of pins 24 (only one of which is shown). Fuel is directed into the chamber 20 through a number of injector nozzles 25 (only one of which is shown) located at the upstream end of the combustion chamber 20. Fuel injector nozzles 25 are circumferentially spaced around the engine 10 and serve to spray fuel into air derived from the high pressure compressor 14. The resultant fuel/air mixture is then combusted within the chamber 20.

The combustion process which takes place generates a large amount of heat. It is therefore necessary to arrange that the inner and outer wall structures 21 and 22 are capable of withstanding this heat.

The inner and outer wall structures 21 and 22 are of generally the same construction and comprise an outer wall 27 and an inner wall 28. The inner wall 28 is made up of a plurality of discrete wall elements in the form of tiles 29, which are all of the same general rectangular configuration and are positioned adjacent each other. The cirumferentially extending edges 30, 31 of adjacent tiles overlap each other. Each tile 29 is provided with threaded studs 32 which project through apertures in the outer wall 27. Nuts 34 are screwed onto the threaded studs 32 and tightened against the outer wall 27, thereby securing the tiles 29 in place.

Figure 3:
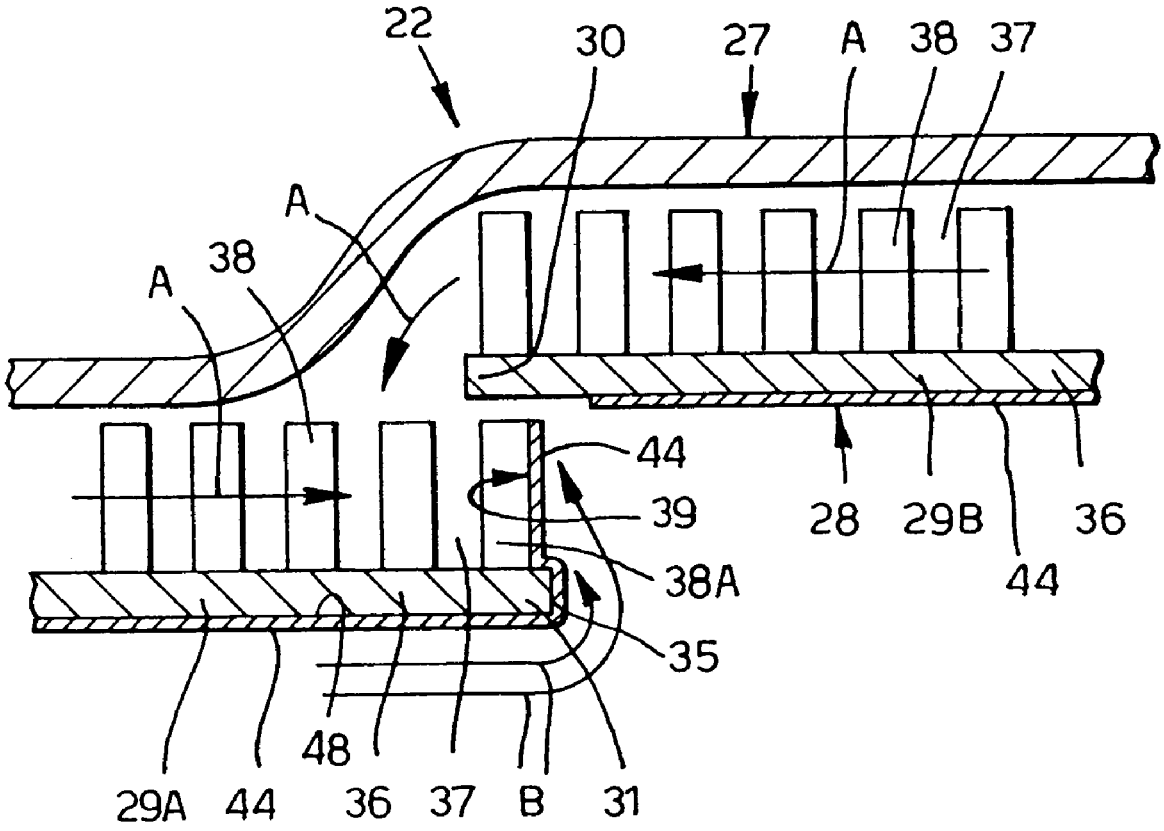
FIG. 3 is a diagrammatic vertical cross-section through part of the wall structure of the combustor shown in FIG. 1.

Referring to FIG. 3, there is shown part of the outer wall structure 22 showing two adjacent overlapping tiles 29A, 29B. Each of the tiles 29A, 29B comprises a main body member 36 which, in combination with the main body members of each of the other tiles 22, defines the inner wall 28. A plurality of heat removal members in the form of upstanding substantially cylindrical pedestals 38 extend from each body member 36 towards the outer wall 27. The downstream edge region 31 of the tile 29A overlaps the upstream edge region 30 of the tile 29B and the end face of the downstream edge region 31 is exposed to the combustion chamber.

The outer wall 27 is provided with a plurality of feed holes (not shown) to permit the ingress of air into the space 37 between the main body member 26 of each tile 29 and the outer wall 27. The arrows A in FIG. 3 indicate the general direction of air flow in the space 37, this air flow being rendered turbulent by virtue of the obstruction opposed to it by the heat removal pedestals 38. The pedestals 38 located adjacent to the exposed downstream edge 35 of each tile are designated 38A and are referred herein as the downstream edge pedestals. It is believed that as the air within the space 37 passes the downstream edge pedestals 38A, a wake region is generated just downstream of each of the pedestals 38A and that combustion gases from the main part of the combustion chamber 20 are entrained by the air flow from the space 37 passing the downstream pedestals 38A, these gases being drawn into the wake region as indicated by the arrows B. The temperature of these combustion gases is in the region of 2,600° C. which is sufficiently high to thermally erode the downstream pedestals 38A. A heat resistant material in the form of a thermal barrier coating 44 is provided on the downstream edge surface 35 of the main member 36 and on a downstream facing region 39 of each of the downstream pedestals 38A. The inward facing surface 48 of the main member 36 is also provided with the thermal barrier coating 44. The provision of the thermal barrier coating 44 prevents the thermal erosion of the downstream pedestals 38A, and of the inward falling surface 48 of the main member 36. The thermal barrier coating 44 is preferably magnesium zirconate or yttria stabilised zirconia.

Figure 4:
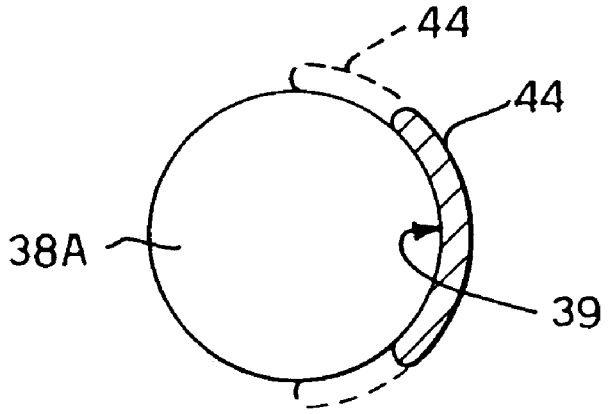
FIG. 4 is a top plan view of a heat removal member.

Referring to FIG. 4, there is shown a top plan view of one of the downstream pedestals 38A. Each downstream pedestal 38A is provided with the thermal barrier coating 44 along substantially the whole length of the pedestal on the downstream facing region 39 thereof. The coating extends around an arc of substantially 90° around the downstream pedestals 38A, as shown in full lines in FIG. 4, but if desired, the coating 44 could extend around an arc of substantially 180°, as shown by the dotted lines. It is preferred that the coating 44 does not extend around an arc greater than substantially 180°.

The arrangement described provides substantially increased tile life of the downstream edge region of the tiles and of the downstream pedestals 38A. Consequently, the tiles themselves have an increased life.

Various modifications can be made without departing from the scope of the invention. For example the tile pedestals may be of various cross-sectional shapes and of different spacings and dimensions and alternative thermal barrier coating materials may be employed.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A combustor for a gas turbine engine, the combustor comprising an outer wall, an upstream end and a downstream end with fluid flow through said combustor progressing from said upstream end toward said downstream end and an inner wall element comprising a main body member, a plurality of heat removal members on said main body member extending from said main body moving towards said outer wall, and at least one surface, the surface, in use, facing said downstream end relative to the general direction of fluid flow through the combustor and including a downstream facing surface of at least one of said heat removal members, wherein at least said downstream facing surface comprises a thermal barrier coating.

2. A combustor according to claim 1 wherein said heat removal members have a selected length and said thermal barrier coating extends substantially the whole length of said heat removal members.

3. A combustor according to claim 1 wherein the heat removal members extend away from the main body member.

4. A combustor for a gas turbine engine according to claim 1 wherein the thermal barrier coating is magnesium zirconate.

5. A combustor for a gas turbine engine according to claim 1 wherein the thermal barrier coating is yttria stabilized zirconia.

* * * * *